US005415392A

United States Patent [19]

Maul

[11] Patent Number: 5,415,392

[45] Date of Patent: May 16, 1995

[54] DEVICE FOR ADJUSTING GRIPPER TIMING AT SHEET DELIVERIES

[75] Inventor: Bernhard Maul, Heidelberg, Germany

[73] Assignee: Heidelberger Druckmaschinen AG, Heidelberg, Germany

[21] Appl. No.: 326,044

[22] Filed: Oct. 19, 1994

Related U.S. Application Data

[63] Continuation of Ser. No. 91,963, Jul. 15, 1993, abandoned.

[30] Foreign Application Priority Data

Jul. 15, 1992 [DE] Germany ..... 42 23 232.5

[51] Int. Cl.[6] ..... B65H 5/02

[52] U.S. Cl. ..... 271/277; 198/803.7; 198/364

[58] Field of Search ..... 271/82, 85, 268, 277; 198/803.7, 470.1, 364

[56] References Cited

U.S. PATENT DOCUMENTS

| | | | |
|---|---|---|---|
| 3,837,474 | 9/1974 | Brooke | 198/803.7 X |
| 4,522,293 | 6/1985 | van Kattenbroek | 198/470.1 X |
| 4,569,444 | 2/1986 | McEvoy et al. | 198/364 X |
| 4,643,414 | 2/1987 | Weisgerber | 271/183 |
| 4,776,465 | 10/1988 | McEvoy et al. | 198/364 X |
| 4,799,664 | 1/1989 | Burger | 271/277 |
| 4,905,986 | 3/1990 | Muller | 271/277 |
| 4,953,847 | 9/1990 | Honeggar | 271/277 |
| 5,007,629 | 4/1991 | Eberle et al. | 271/277 |
| 5,168,977 | 12/1992 | van Essen et al. | 198/364 |

FOREIGN PATENT DOCUMENTS

| | | |
|---|---|---|
| 628450 | 3/1936 | Germany . |
| 1119300 | 7/1962 | Germany . |
| 2810874 | 11/1983 | Germany . |
| 3413179 | 10/1985 | Germany . |
| 3002591 | 9/1989 | Germany . |
| 943114 | 11/1963 | United Kingdom . |

*Primary Examiner*—H. Grant Skaggs
*Assistant Examiner*—Carol L. Druzbick
*Attorney, Agent, or Firm*—Herbert L. Lerner; Laurence A. Greenberg

[57] ABSTRACT

A device for adjusting the release point of the timing of a gripper release in a sheet delivery of a sheet-processing machine, such as a printing machine, is disclosed. A gripper system is driven along a given travel path. The gripper system has gripper fingers for clamping a paper sheet, entraining the paper sheet along the given travel path and releasing the paper sheet at a predetermined position. A landing body with a cam surface is disposed at a stationary support structure and it is operatively associated with a member for releasing the paper sheet which travels with the grippers. The landing body is shiftable on a displacement track for the purpose of adjusting the timing of the paper release. The displacement track has a shape which is adapted to a geometric course of the given travel path of the gripper system.

15 Claims, 1 Drawing Sheet

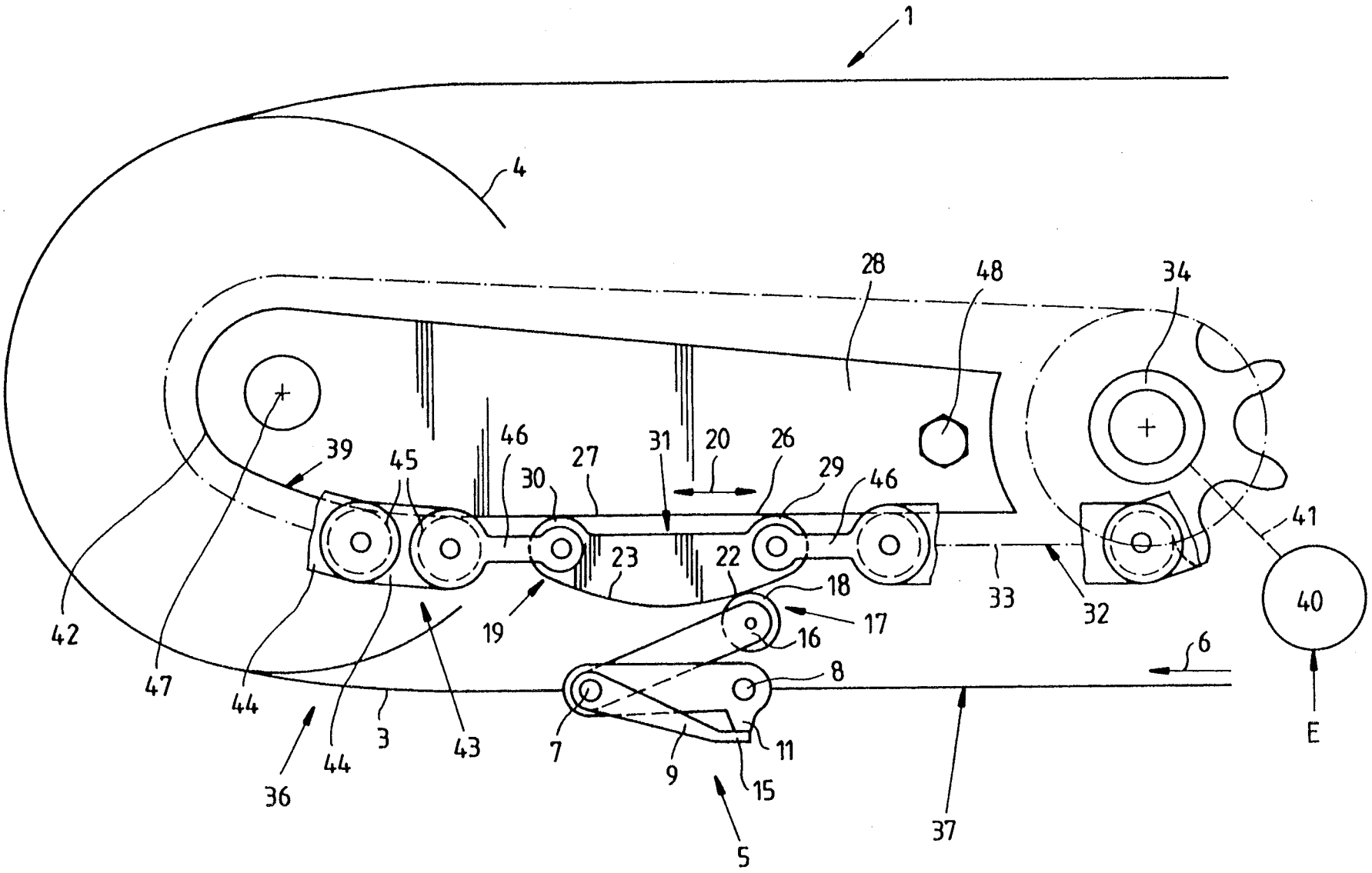
1
4
28
48
34
41
40
E
6
32
33
37
46
29
26
20
31
27
30
46
39
42
47
44
45
43
19
23
22
18
17
16
8
11
15
5
9
7
3
36

DEVICE FOR ADJUSTING GRIPPER TIMING AT SHEET DELIVERIES

This application is a continuation of application Ser. No. 08/091,963, filed Jul. 15, 1993, now abandoned.

BACKGROUND OF THE INVENTION

1. Field of the Invention

The invention relates to a device for controlling the timing of grippers in a sheet delivery of a sheet-processing machine, in particular a sheet-fed printing machine, whereby the grippers release the entrained sheets at a predetermined location by controlled opening in dependence on various parameters, such as paper bond, sheet velocity, etc., and deliver the same to a sheet stack, and whereby the opening time or the opening position can be determined by shifting a landing body against which gripper opening means impinge which move with the grippers along a given travel path.

The invention is applicable in sheet-processing machines wherever sheets are transported by means of a transport device with grippers. The sheets are released from the grippers at a predetermined location for lowering on a sheet stack. The invention is particularly well suited in sheet-fed printing machines, in which the sheets transported by the sheet delivery are deposited on a sheet delivery table.

Chain deliveries are well known in printing machines. Gripper systems are evenly distributed about a continuous chain, usually two spaced-apart chains. The gripper systems grip a printed sheet arriving from the printing unit of the printing machine and then entrain and transport the same to the delivery table. At the delivery table, the grippers of the gripper system open up and release the sheet for deposit on the sheet stack. Various parameters define the exact time and/or location at which the grippers must be opened such that the sheet is properly released. Such parameters include the weight of the sheet, the printing speed and sheet velocity, the sheet format, etc. The opening time and location are predetermined.

A device of the foregoing type is known from German Patent 28 10 874, in which the grippers impinge on a landing body. The landing body actuates gripper opening means and the gripper releases the entrained sheets. The position of the landing body can be manually adjusted in dependence on the above-mentioned parameters. Printing speed is automatically taken into account, i.e. a change in the printing speed also causes a change in the position of the landing body. The landing body of the known device extends longitudinally in the travel direction of the grippers; it may be axially displaced and thereby brought into the desired position. The above-mentioned axial displacement of the landing body is effected by manually rotating a spindle. The spindle itself is axially shifted in dependence on the printing speed of the sheet-fed printing machine via a suitable mechanical assembly.

The known device must be built relatively long if an even opening behavior of the grippers is desired along the entire adjusting region of the landing body. Any shortening of the structure would bring about an undesirable shortening of the adjusting region or one would leave the straight-line region and move into the curved reversal region of the travel path. This would lead to inconsistent landing and roll-off angles of the gripper opening means on the landing body, as seen in comparison with other parts in the adjusting region. This, in turn, would lead to corresponding landing and roll-off shocks and thereby to great mechanical stresses and increased noise production. Also, it is not ensured that the grippers open up equally wide within the adjusting region, instead their opening width is uneven and in some regions unnecessarily large.

SUMMARY OF THE INVENTION

It is accordingly an object of the invention to provide a device for adjusting gripper timing at sheet deliveries, which overcomes the hereinafore-mentioned disadvantages of the heretofore-known devices of this general type and which provides a large adjusting region in spite of being built relatively short, i.e. the ratio between a length of the adjusting region to a length of the sheet delivery is vastly improved.

With the foregoing and other objects in view there is provided, in accordance with the invention, a device for adjusting the timing of a gripper release in a sheet delivery of a sheet-processing machine in which paper sheets are conveyed along a given conveying direction, comprising:

a support structure;

one or several gripper systems driven about the support structure along a given travel path, the gripper system having means for clamping a paper sheet, entraining the paper sheet along the given travel path and releasing the paper sheet at a predetermined position;

a landing body disposed at the support structure and operatively associated with the means for releasing the paper sheet;

the support structure including a displacement track on which the landing body is displaceable substantially along the paper sheet conveying direction; and the displacement track having a shape adapted to a geometric course of the given travel path of the gripper system.

In accordance with an added feature of the invention, the landing body has a landing surface and a roll-off surface being inclined relative to and forming landing and roll-off angles, respectively, with the given travel path, wherein the means for releasing the paper sheet include a roller impinging on the landing surface and rolling from the landing surface to the roll-off surface when the gripper system travels along the given travel path, and wherein the displacement track is adapted to the given travel path in such a way that the landing angle remains virtually unchanged when the landing body is displaced along the displacement track.

In accordance with an additional feature of the invention, the gripper system includes gripper fingers and gripper seats defining a closed position for clamping the paper sheet therebetween and an open position where the paper sheet is released, the open position defining an opening angle, the displacement track being adapted to the given travel path in such a way that the opening angle remains virtually unchanged when the landing body is displaced along the displacement track.

In other words, it is advantageous when the adjustment track is adapted to the travel path in such a manner that —independently of the opening time or of the opening location of the grippers—approximately identical landing and/or roll-off angles are always present between the gripper opening means and the landing body and/or approximately identical gripper opening movement.

In accordance with another feature of the invention, the given travel path includes a first curved segment in the vicinity of a reversal point, the displacement track including a corresponding, second curved segment associated with the first curved segment.

In accordance with a further feature of the invention, the support structure has a surface area, the displacement track being formed on the surface area, and the landing body being supported on the surface area.

In accordance with yet another feature of the invention, the device includes two mutually spaced-apart guide and support members formed on the landing body, the landing body having a recess formed therein between the two guide and support members, the recess having a bottom wall spaced apart from the surface area, the bottom wall remaining spaced apart from the support surface if the landing body is shifted on the displacement track.

In accordance with yet an added feature of the invention, the device includes flexible adjusting means, for instance in the form of an adjusting chain, attached to the landing body for adjusting a position of the landing body on the displacement track. Additionally, the device includes an adjusting wheel rotatingly supported on the support structure and the flexible adjusting means is guided around the adjusting wheel.

The landing body is preferably attached at the two ends of a flexible adjusting means, particularly an adjusting chain. The adjusting chain can be guided about an adjusting wheel as well as about an adjusting means guide region spaced apart therefrom. The landing body can be shifted within the adjusting region along the displacement track, for instance by turning the adjusting wheel for controlling the operating position.

In accordance with again an added feature of the invention, the device includes a guide wheel rotatably supported on the support structure, a delivery chain driven about the guide wheel, the delivery chain carrying the gripper systems in a mutually spaced-apart relationship, the delivery chain following the given travel path, and the given travel path being curved in a region in which the delivery chain is in contact with the guide wheel and in regions directly adjacent the contact regions.

In accordance with again a further feature of the invention, the device includes a control drive connected to the adjusting wheel for positioning the landing body on the displacement track.

With the above and other objects in view, there is further provided, in accordance with the invention, in a delivery of a paper sheet-processing machine of the type in which a gripper grips a paper sheet at a pick-up location, entrains the paper sheet along a given travel path, releases the paper sheet at a defined release point, and travels about a reversal point back to the pick-up location, wherein the release of the paper at the release point is effected in that an actuating member traveling with the gripper impinges on a cam surface which, through the actuating member, opens the gripper; a device for adjusting the release point at which the gripper releases the paper sheet, comprising: a landing body defining a cam surface with a landing surface, the landing surface defining a given angle with the given travel path of the gripper; a displacement track on which the landing body can be shifted substantially parallel to the given travel path, the displacement track having a geometric shape adapted to a geometric course of the given travel path.

In accordance with again an added feature of the invention, the device includes means for determining the release point as a function of parameters selected from the group consisting of paper sheet weight, paper sheet velocity, printing speed and paper format.

In accordance with a concomitant feature of the invention, the device is provided in a printing machine, particularly in a sheet-fed printing machine.

In other words, the objects are solved, in that the shifting of the landing body with the cam surface is effected along a displacement track whose shape is adapted to the geometrical course of the travel path of the grippers.

In the context of this invention, "displacement track" and "travel path" include not only straight-line paths, but also curved paths. As the travel path of the grippers, which is essentially predetermined and constant, does not only follow a straight-line path but, especially in the vicinity of the reversal region (reversal point of the continuous chain), instead a curved path, then the novel course of the displacement track for the landing body changes as well. The change is adapted to the geometrical course of the travel path. This leads to the fact that, independently of the position of the landing body within the adjusting region, virtually identical conditions are achieved, i.e. the landing and roll-off angles of the gripper opening means relative to the landing body remain substantially constant.

Quite importantly, also, the opening angle of the grippers may be adjusted to an optimally small angle. That angle is then retained throughout the adjusting region or, in other words, the angle remains small whether the release point is early or late. The result is found in only slight acceleration values, only small mechanical stress and only little noise production.

Because the adjusting region may extend well into the reversal region of the grippers while, even though the travel path no longer follows a straight line, still optimal conditions are present in the gripper control, it is not necessary to build the delivery very long. This, of course, would be necessary if the adjusting region—as in the prior art—could only be disposed in the straight-line region of the travel path of the grippers. This means that the device according to the invention may be realized in very short deliveries.

The terminology "adapted to" in the claims does not mean that the courses of the travel path and the displacement path must be the same, for example with identical curvature; instead, one path is adapted to the other (e.g. with mutually adapted, different curves). The adaptation is well within the skill in this art, and depends on the curvature of the paths and on the spacing between the support surfaces on the landing body. The two paths exhibit the necessary geometrical shapes so as to produce the optimum gripper opening movement throughout the entire adjusting region.

When the travel path of the grippers has a curved reversal path, it is advantageous when as correspondingly shaped displacement track, particularly a curved section, is associated therewith.

The displacement track is advantageously formed by a surface region on a basic body. The landing body, with a support surface thereof, is supported on the surface region. Due to this support, the landing body is held or guided in a defined position within the adjusting region. For the purpose of perfect guiding, the support surface of the landing body is preferably formed on two mutually spaced-apart guide members, which have a recess formed therein with a depth which is chosen such that a bottom of the landing body does not rest against the displacement track within the displacement region, especially not against the curved part of the displacement track. With the two mutually spaced-apart guide members and the intermediate recess it is assured that, when the landing body is shifted to the curved region of the displacement track, a perfectly and continuously defined support of the support surface on the displacement track is ensured and that any "running-up" of the bottom into an undefined, unstable position is avoided.

As already mentioned, the gripper systems may preferably be attached on a delivery chain in a mutually spaced-apart fashion, whereby the delivery chain is guided about a guide wheel. The guide wheel is disposed in the area of a sheet delivery table, i.e. the already opened grippers are guided back about the guide wheel for receiving further sheets arriving from the printing unit of the sheet-fed printing machine.

It is particularly advantageous, when the adjusting wheel is connected with a controlled drive for positioning the landing body.

Other features which are considered as characteristic for the invention are set forth in the appended claims.

Although the invention is illustrated and described herein as embodied in a device for adjusting gripper timing at sheet deliveries, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawing.

BRIEF DESCRIPTION OF THE DRAWING

The figure is a schematic side-elevational view of a device for controlling the timed opening point of grippers in a sheet delivery of a sheet-processing machine.

DESCRIPTION OF THE PREFERRED EMBODIMENTS

Referring now to the sole figure of the drawing in detail, there is seen a schematic view of parts of a sheet delivery 1 of a sheet-fed printing machine. The sheet delivery 1 is formed as a chain delivery, i.e. it has a delivery chain 3. In the vicinity of a non-illustrated sheet delivery table, the chain 3 is guided about a guide wheel 4. That area is also referred to as the sheet delivery region and the chain reversal region.

Gripper systems 5 are attached on the delivery chain 3 in an evenly spaced relationship (for reasons of simplicity, the figure illustrates only a single gripper system). The gripper system 5 entrains a printed sheet arriving from the printing unit and transports the same to the sheet delivery table, where the sheet is placed on a stack. The transport or travel direction is indicated in the figure with an arrow 6. Each gripper system 5 includes two shafts or groove stems 7 and 8, which are attached at the delivery chain 3.

Gripper fingers 9 of the gripper system 5 are mounted on the forward groove stem 7, which is formed as a gripper shaft. Gripper seats 11 which are associated with the gripper fingers 9 are disposed on the following groove stem 8.

The forward groove stem 7 is non-rotatably connected with an actuating lever 16 for actuating the gripper fingers 9. The other, free end of the actuating lever 16 carries gripper opening means 17 in the form of a landing roller or cam follower 18. A non-illustrated printed sheet is clamped between the gripper seat 11 and a free end 15 of the gripper finger 9. From the non-illustrated pick-up location (e.g. at the printing unit), the sheet follows the transport direction (arrow 6) all the way to the region of the guide wheel 4, where it is released by opening the gripper fingers 9 and from where it is stacked on the sheet delivery table.

The gripper opening means 17 cooperate with a landing body or cam 19, which is positionable along a defined adjusting region. The adjusting directions are indicated with a double arrow 20. The landing body 19 has a landing slope 22 and—as seen in the transport direction (arrow 6)—a downstream roll-off slope 23. The landing and roll-off slopes 22 and 23 may also be referred to as opening and closing slopes, respectively. The landing body 19 has guide and support members 29 and 30 provided at its two ends. The landing body 19 is thus supported on a displacement track 26 which is formed by a surface region 27 of a basic body 28. The basic body 28, together with a non-illustrated frame, may be referred to as a support structure. The landing body 19 has a recess 31 formed between the guide members 29 and 30. Accordingly, the body 19 is spaced apart from the displacement track 26 along the entire adjusting region.

The two ends 29 and 30 of the landing body 19 are attached to flexible adjusting means 32, which are formed as an adjusting chain 33. The adjusting chain 33 is guided about a sprocket wheel or chain wheel 34. The sprockets of the wheel 34 mesh with the adjusting chain 33 in an accurately form-locking manner.

In the vicinity of a rotational axis of the guide wheel 4, the displacement track 26 follows a transition into an adjusting means reversal region 42, i.e. the adjusting chain 33 is guided around that location. From the reversal region 42 it is guided back to the adjusting wheel 34. The adjusting chain 33, which is formed of fish-plates or shackles 44 and rollers 45 carried thereon, lies on the displacement track 26. More particularly, the peripheral surfaces of the rollers 45 lie on the track 26.

The measurements of the adjusting chain 33 and the basic body 28 are mutually coordinated such that the shackles 44 of the adjusting chain 33 reach around the basic body 28 and thus assume the function of a tread-and-flange type guide. The ends of the adjusting chain 33 are articulated at the guide members 29 and 30 of the landing body 19 by means of end plates 46. In the instant embodiment, the basic body 28 is mounted on a trunnion 47, which lies essentially in the rotational center of the guide wheel 4. At is opposite end, the basic body 28 is attached to the sheet delivery 1 by means of a nut and bolt connection 48.

The location of the landing body 19 can be adjusted via the adjusting chain 33 by means of the adjusting wheel 34. As mentioned above, the adjustment becomes necessary or advantageous when certain parameters change. Those include the weight of the paper, the printing speed, the sheet velocity, the sheet format, and so on. It is important to ensure that the sheets are always released at the correct opening time and at the predetermined position of the gripper system 5. The positioning of the landing body 19 may be effected manually and/or automatically. In this respect, means are provided for overriding any automatic adjusting devices, so that the timing chain 33 may be shifted manually if needed.

The operation of the timing control is as follows: As the gripper system 5 approaches with a clamped and entrained sheet, the landing roller 18 runs onto the landing slope 22 of the landing body 19. The landing body has been positioned according to the prevalent operating parameters. The actuating lever 16 is pivoted in a clockwise direction and the free ends 15 of the gripper fingers 9 are moved away from the gripper seat 11. The previously clamped sheet is now released. The clamping of the sheet may be effected by non-illustrated springs, which bias the gripper fingers 9 against the gripper seat 11. When the landing roller 18 reaches the roll-off slope or closing slope 23 of the landing body 19 as the gripper system moves to the left, the individual gripper fingers 9 of the gripper system 5 close again and, by means of the delivery chain 3, they are guided around the guide wheel 4 back to the printing unit of the sheet-fed printing machine, where another sheet may be received and clamped.

Due to the indicated geometrical course of the transport path of the delivery chain 3, each gripper system 5 assumes a corresponding position. In other words, the gripper system 5 does not only move on a straight-line path, but—particularly in the reversal region 36 of the guide wheel 4 —also in a curved path. That curved path, it must be noted, is not only present directly at the guide wheel 4, but also shortly in front and behind the same. The position and the curves change depending on where the respective gripper system 5 is located. What this means is that, within the adjusting region of the landing body 19, there do not exist permanently identical, but continuously changing conditions with regard to the gripper opening control and thus with regard to the timing and also to the opening width of the gripper fingers.

Due to these conditions, which are not the same about the entire adjusting region, the landing angle (defined as the angle formed between the landing slope and the travel path) and the roll-off angle (defined as the angle formed between the roll-off slope and the travel path) of the landing roller 18 relative to the landing body 19 would change, if the latter—as in the prior art—were straight. That would lead to the disadvantages mentioned in the introductory description.

It is thus provided, in accordance with the invention, that the shape of the displacement track 26 is correspondingly adapted to the geometric course of the travel path 37 (course of the delivery chain 3). This means that the displacement track 26 is adapted to the travel path of the gripper systems in such a manner that—about the entire adjusting range of the landing body—approximately identical landing and roll-off angles of the gripper opening means 17 relative to the landing body 19 are ensured. Additionally, very small gripper opening angles, once set, are traversed regardless of where the landing body is located within the adjusting region.

The result is low-shock operation, with correspondingly small mechanical stresses on the delivery and with surprisingly low noise production. In particular, it is possible with the invention that the adjusting region reaches all the way into the reversal region 36 of the gripper systems 5, i.e. the landing body 19 can be shifted into the region of the guide wheel 4. The guide and support members 29 and 30 are supported in a defined manner on the curved displacement track 26 and thus provide optimum landing and roll-off angles for the landing roller 18. In that region, the recess 31 prevents the landing body 19 from being supported on the curve of the displacement track 26 in an undefined manner. Because an adjustment of the landing body 19 is possible up to the earlier described region and because the timed opening of the gripper fingers 9 may be effected at that late point, the sheet delivery 1 can be built very short.

Finally, the figure shows a drive 40, which is controlled with an input parameter E. The adjusting wheel 34 can be turned with the drive 40. The drive may be formed as an electrical actuator, and it drives the adjusting wheel via a mechanical operative connection 41 (e.g. a transmission), which is not shown in detail. The landing body 19 is positionable in whichever desired position within the adjusting region by means of the adjusting chain 33. The motor-actuated adjustment is provided in accordance with a special embodiment. Alternatively, of course, it is also possible to provide for a different kind of positioning of the landing body, for instance manual.

I claim:

1. Gripper releasing device in a sheet delivery of a sheet-processing machine in which paper sheets are conveyed along a given conveying direction, comprising:

a support structure;

a gripper system driven about said support structure along a given travel path; a plurality of sheet releasing positions defined along a portion of said travel path; said gripper system having means for releasably clamping a paper sheet and conveying the paper sheet along said given travel path to a respective one of said sheet releasing positions;

a landing body disposed at said support structure at a respective one of said sheet releasing positions;

said support structure including a displacement track on which said landing body is displaceable into a respective one of said sheet releasing positions;

said means for releasably clamping the paper sheet being actuated for releasing the paper sheet by moving past said landing body located at a respective one of said sheet releasing positions;

said portion of said travel path at which said plurality of sheet releasing positions are defined having a geometric course which includes at least a curved section;

said displacement track having a shape adapted to the geometric course of said portion of said travel path.

2. The device according to claim 1, wherein said gripper system is a plurality of gripper systems.

3. The device according to claim 2, including a guide wheel rotatably supported on said support structure, a delivery chain driven about said guide wheel, said delivery chain carrying said gripper systems in a mutually spaced-apart relationship, said delivery chain following said given travel path, and said given travel path being curved in a region in which said delivery chain is in contact with said guide wheel and in regions directly adjacent the contact regions.

4. The device according to claim 1, wherein said landing body has a landing surface and a roll-off surface being inclined relative to and forming landing and roll-off angles, respectively, with said given travel path, wherein said means for releasing the paper sheet include a roller impinging on said landing surface and rolling from said landing surface to said roll-off surface when said gripper system travels along said given travel path, and wherein said displacement track is adapted to said given travel path in such a way that said landing angle remains substantially unchanged when said landing body is displaced along said displacement track.

5. The device according to claim 1, wherein said gripper system includes gripper fingers and gripper seats defining a closed position for clamping the paper sheet therebetween and an open position where the paper sheet is released, the open position defining an opening angle, said displacement track being adapted to said given travel path in such a way that said opening angle remains substantially unchanged when said landing body is displaced along said displacement track.

6. The device according to claim 1, wherein said given travel path includes a reversal segment, said curved section including at least a part of said reversal segment.

7. The device according to claim 1, wherein said support structure has a surface area, said displacement track being formed on said surface area, and said landing body being supported on said surface area.

8. The device according to claim 7, including two mutually spaced-apart guide and support members formed on said landing body, said landing body having a recess formed therein between said two guide and support members, said recess having a bottom wall spaced apart from said surface area, said bottom wall remaining spaced apart from said support surface if said landing body is shifted on said displacement track.

9. The device according to claim 1, including flexible adjusting means attached to said landing body for adjusting a position of said landing body on said displacement track.

10. The device according to claim 9, wherein said flexible adjusting means are an adjusting chain.

11. The device according to claim 9, including an adjusting wheel rotatingly supported on said support structure, said. flexible adjusting means being guided around said adjusting wheel.

12. The device according to claim 11, including a control drive connected to said adjusting wheel for positioning said landing body on said displacement track.

13. In a delivery of a paper sheet-processing machine of the type in which a gripper grips a paper sheet at a pick-up location, entrains the paper sheet along a given travel path, releases the paper sheet at one of a plurality of defined release points, and travels about a reversal point back to the pick-up location, wherein the release of the paper sheet at the respective release point is effected in that an actuating member traveling with the gripper impinges on a cam surface which, through the actuating member, opens the gripper for releasing the paper sheet;

a device for adjusting the release point at which the gripper releases the paper sheet, comprising:

a landing body defining a cam surface with a landing surface, said landing surface defining a given angle with the given travel path of the gripper;

a displacement track on which said landing body is shiftable substantially parallel to the given travel path for adjusting the release point to one of the plurality of defined release points; the gripper including means for releasably clamping the paper sheet, said means being actuated for releasing the paper sheet by passing said landing body located at a respective one of said sheet releasing positions;

a portion of said travel path at which said plurality of sheet release points are defined having a geometric course which includes at least a curved section;

said displacement track having a shape adapted to the geometric course of said portion of said travel path at which the release points are defined.

14. The device according to claim 13, including means for determining the release point as a function of parameters selected from the group consisting of paper sheet weight, paper sheet velocity, printing speed and paper format.

15. The device according to claim 13, wherein the sheet-processing machine is a unit in a printing machine.

* * * * *